US005102262A

United States Patent [19]

Brown

[11] Patent Number: 5,102,262

[45] Date of Patent: Apr. 7, 1992

[54] FENCE FOR ENCLOSING IMPURITIES FLOATING ON WATER

[76] Inventor: Norman D. Brown, P.O. Box 152, Leavenworth, Ind. 47137

[21] Appl. No.: 615,039

[22] Filed: Nov. 19, 1990

[51] Int. Cl.[5] ..... E02B 15/04

[52] U.S. Cl. ..... 405/70; 405/63; 405/72; 210/923

[58] Field of Search ..... 405/60, 63–66, 405/70–72; 210/242.1, 243.3, 923; 441/133, 136

[56] References Cited

U.S. PATENT DOCUMENTS

| | | | |
|---|---|---|---|
| 3,685,296 | 8/1972 | Bogosian | 405/72 X |
| 3,757,526 | 9/1973 | Larsson | 405/70 |
| 3,786,637 | 1/1974 | Muramatsu et al. | 405/72 |
| 3,798,913 | 3/1974 | Dubois | 405/70 X |
| 3,921,407 | 11/1975 | Neal | 405/63 |
| 3,924,412 | 12/1975 | Bennett et al. | 405/67 |
| 4,073,143 | 2/1978 | Preus | 405/70 |
| 4,089,178 | 5/1978 | Kinase et al. | 210/923 X |
| 4,124,981 | 11/1978 | Preus | 405/66 |
| 4,129,989 | 12/1978 | Niemi et al. | 405/70 |
| 4,143,987 | 3/1979 | Welsh | 403/348 |
| 4,155,664 | 5/1979 | Acheson | 405/70 X |
| 4,188,155 | 2/1980 | Langermann | 405/63 |
| 4,248,547 | 2/1981 | Brown | 405/72 |
| 4,295,756 | 10/1981 | Blair | 405/70 |
| 4,333,726 | 6/1982 | Fuxelius | 405/72 |
| 4,367,979 | 1/1983 | Milligan | 405/70 |

*Primary Examiner*—David H. Corbin
*Assistant Examiner*—John Ricci

[57] ABSTRACT

A fence for enclosing impurities floating on water including a series of bands of two-ply material with the two plies fused together in selected areas including the entire upper edge and with weighted floating pickets inserted vertically between the two plies up to the fused upper edge with both plies extending beyond each band at both ends of the band, one ply at both ends being wrapped about end pickets which are pressed together to form a juncture between bands and with the other plies extending beyond the bands being folded over one another and sealed together to prevent leakage at the juncture.

11 Claims, 2 Drawing Sheets

FENCE FOR ENCLOSING IMPURITIES FLOATING ON WATER

BACKGROUND OF THE INVENTION

This invention relates to a fence for enclosing impurities floating on water.

Previously hereto, U.S. Pat. No. 4,248,547 was issued which patent described and claimed a two-ply fence for enclosing impurities on water with the two plies fused together in substantial areas and with weighted floating pickets located between the two plies. Rings were located at both ends of all of the pickets with one rope extending through rings affixed at the upper ends of the pickets and another rope extending through the rings at the lower ends of the pickets. Two other ropes extended through the plies and around the pickets.

The earlier fence described and claimed in U.S. Pat. No. 4,248,542 was and still is a substantial improvement over the prior art then known in that it provided an economical fence and especially a fence which can be readily rolled for storage and transporting. However, further economy in production of the fence and ease of handling has been achieved by the present invention.

Since in the present invention two plies of material are fused in a planned pattern with only a limited portion of the two plies being fused together, a wide range of coated fabrics may be used. The continued repetition of a fixed pattern of fusing can also be readily provided by changing the positions of fusing elements, rather than the redesign and repreparation of templates as was required by the earlier invention.

Another problem with the earlier fence, as well as other existing fences, is that in connecting the corresponding ends of two adjoining bands, which are sections of the fence, together, a substantial problem of leakage often does result. For convenience of handling bands must be constructed only to a limited length, usually about fifty feet, and therefore several bands must be connected end to end in order to contain the impurities. Prior to this invention, each such end to end connection frequently would lack the impervious quality of the fence itself, thus providing for leakage of impurities outside of the enclosure provided by the fence. In the alternative, where positive connection has been provided, earlier designs required expensive interlocking parts usually heavy and difficult to handle.

The benefits of improved function and exceptional economy of production as well as ease of handling are provided by this invention, along with exceptional prevention of leakage at the connection between the bands.

SUMMARY OF THE INVENTION

In accordance with the present invention, there is provided an improved fence for enclosing impurities floating on water. The fence is formed from a series of bands which are interconnected sections of the fence. Each band is formed by fusing together in selected areas two plies of flexible impervious material capable of being bonded together by such means as heat fusion, sewing or possibly adhesive The upper edge of each band is continuously fused together with a plurality of fused strips spaced vertically and horizontally from one another with the lower fused strips being along the lower edge of the band.

The longitudinal spacing of the fused sections forms pockets in the band into which inner pickets are placed. Each inner picket is formed in a generally cylindrical shape made from a material having a density lighter than water and with its lower end weighted at its lower end. At both ends of each band an extension or flap of two ply material is left unfused. At both ends of each band, one of the two plies is wrapped around an end picket and fused to itself to form a pocket for an end picket which is similar to an inner picket, but with a ring at the upper end as well as at the lower end.

Adjacent to each point of fusion of the plies used to form the pockets for the end pickets, a strip of adhesive material such as hook and loop material is vertically placed from the upper edge to the lower edge of the band. On the vertical edge of the remaining ply at each end, another strip of adhesive material such as hook and loop material is also placed from the upper edge to the lower edge.

The two end pickets of adjoining bands are firmly secured together by securing the rings at the upper ends and the lower ends of the end pickets forming a juncture between adjoining bands.

The flaps of the other plies at adjoining ends are folded over one another and secured together by the adhesive strips further to prevent leakage at the juncture.

The novel features which are considered as characteristics of the invention are set forth with particularity in the appended claims. The invention itself, however, as to its construction and obvious advantages, will be best understood from the following description and the specific embodiment when read with accompanying drawings.

DETAILED DESCRIPTION OF THE INVENTION

Figure 1:
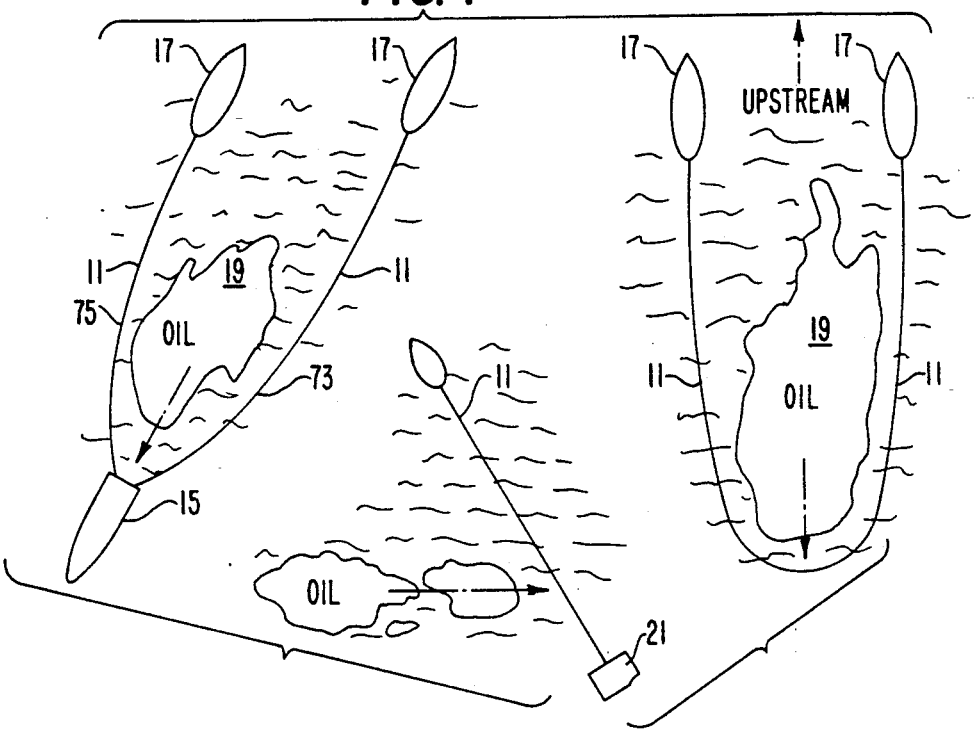
FIG. 1 is an overall environmental perspective view showing three separate applications of the fence in controlling impurities such as an oil spill on water.

The same reference numerals are used throughout the drawings and specification to note a similar item of the invention.

Referring now to FIG. 1, a fence 11 generally used for enclosing impurities floating on water includes a series of bands or sections 13. Since a fence 11 must be of such a length that it can be neither made nor transported in one piece, production in bands 13, normally fifty feet in length, is essential. The fence 11 is formed by connecting the bands or sections 13 together.

In the left side of FIG. 1 as viewed, a pickup boat 15 is shown being connected to two separate lengths of fence 11 to two separate tow boats 17 separated from one another to form a catch area 19 for removing a spill of oil or other impurities.

To the right of FIG. 1 is shown one length of fence connected at each end to a pair of separated tow boats 17 to create a generally U-shaped enclosure or catch area 19 to pull the impurities in a single direction.

Between the left side and right side of FIG. 1 is a single in line fence 11 extending from a drag buoy 21 or from a shore point to a tow boat 17 to create a barrier to flow of the impurities.

Figure 2:
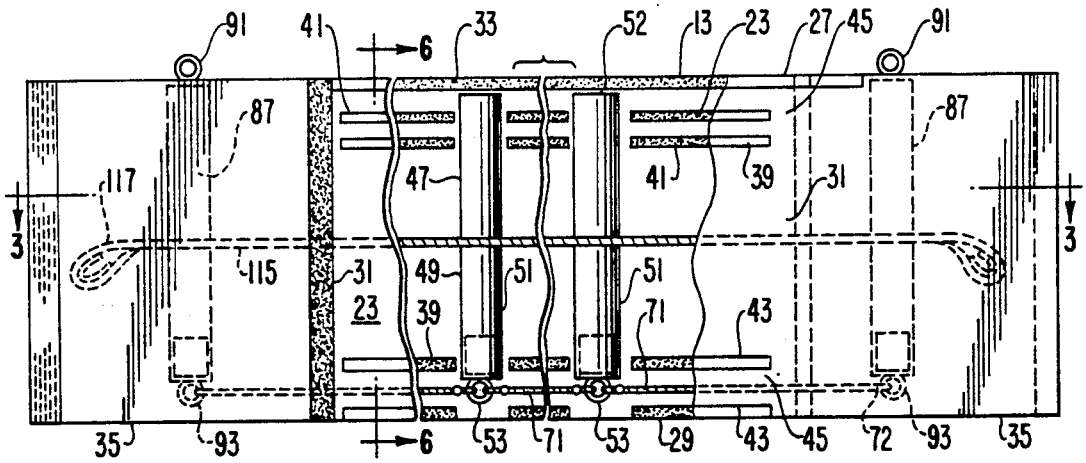
FIG. 2 is an elevation of the fence with certain areas broken away to show the inner pickets inside the fence and the end pickets substantially in dotted lines.
Figure 3:
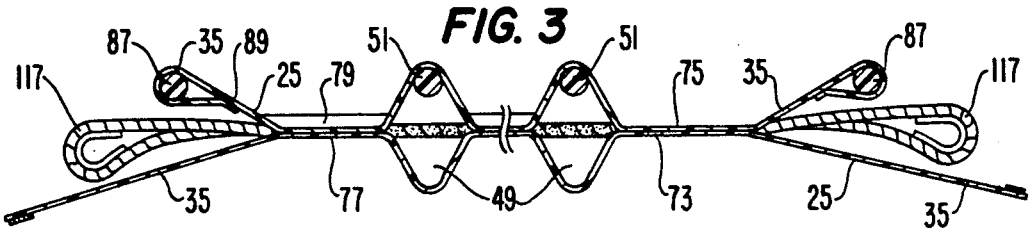
FIG. 3 is a horizontal cross-section along line 3—3 of FIG. 2.

Each band 13 includes numerous panels 23, approximately twenty being preferred in a fifty foot band as shown in FIG. 2. The bands 13 are formed from two plies 25 of material. The material used for the two plies 25 is preferably a coated, cured and finished fabric capable of fusion by heat treatment.

The two plies 25 are joined together in specific areas only preferably by heat treatment and these areas are referred to herein as "fused strips." Heat treatment is the preferred method of fusion, but other means including sewing or the use of adhesives could produce a fence 11 with the same characteristics, the choice being one of ease and cost of manufacture. The term "fused strips" includes all such methods of bonding and fusing.

Each band 13 has an upper edge 27, a lower edge 29, and two side edges 31. Along the upper edge 27, an upper edge fused strip 33 extends substantially across all panels 23 within the band 13 thereby fusing the entire upper edge 27 of the band 13. At the side edges 31 of each band 13 beyond the band 13 and the panels 23 there are flaps 35 which are extensions of the two plies 25 of material, but which are not fused to one another, but used to form a leak proof connection or juncture 37 between adjoining bands 13 as is described hereinafter.

The upper edge fused strip 33 located along the upper edge 27 of each band 13 does not extend beyond the panels 23 and the flaps 35 are not fused along their upper edge 27. Each panel 23 has its own fused strips 39, being two pairs of fused strips 39, all four fused strips 39 being substantially horizontal and substantially parallel with each other and with substantially the same length. Each fused strip 39 preferably has a width of approximately one inch, but this dimension can vary depending on the strength of the fusion strip 39 which can vary with different materials as well as the manner of adhesion. The two pairs of fused strips 39 include a pair of upper fused strips 41 and a pair of lower fused strips 43. Both the pair of upper fused strips 41 and the lower pair of fused strips 43 have substantially the same length and are substantially parallel and vertically aligned with one another.

The pair of upper fused strips 41 in each panel 23 are located adjacent, but in a spaced relationship to the upper edge fused strip 33 along the upper edge 27 of each band 13. The lower pair of fused strips 43 are located with one fused strip 39 along the lower edge 29 of the panel 23 and the other fused strip 39 adjacent to, but in a spaced relationship to and immediately above the lower edge 29 of each panel 23.

Both the pair of upper fused strips 41 and the pair of lower fused strips 43 extend horizontally substantially parallel with the upper edge 27 and the lower edge 29 of each panel 23. Each fused strip 39 in the pair of upper fused strips 41 and the pair of lower fused strips 43 extends substantially across its own respective panel 23 within the band 13. The pairs of upper fused strips 41 and the pairs of lower fused strips 43 in all of the panels 23 are substantially of the same length and are horizontally aligned with one another. A horizontal space 45 exists between the contiguous and adjoining pairs of upper fused strips 41 and the same horizontal space 45 exists between contiguous and adjoining pairs of lower fused strips 43. In this way, a vertical gap 47 in which there is no fusion of the two plies 25 from the lower edge of the band up to the upper edge fused strip 33 is formed between the two plies 25. Each vertical gap 47, provides a pocket 49 between the two plies 25 in which an inner picket 51 can be placed.

As is best seen in FIG. 2, the inner pickets 51 are fitted into the pockets 49. The upper end 52 of each inner picket 51 is held in the fence 11 by the upper edge fused strip 33.

Figure 8:
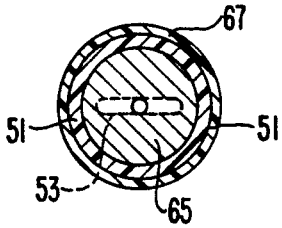
FIG. 8 is a cross-section along line 8—8 of FIG. 7.

Each inner picket 51, as seen best in FIG. 8, has a loop or ring 53 at its lower end and is blunt at its upper end 52. Each inner picket 51 has a core 57 formed from a lighter than water material to provide floatation, such lighter than water material preferably being a closed-all plastic. Preferably, when the most severe service is anticipated, the loop or ring 53 at the lower end of the inner picket 51 includes a lower cap 59 on which the ring or loop 53 is mounted with a rod 61 threaded into it. The lower cap 59 may be eliminated when less servere service is to be performed. The rod 61, which is generally located along the centerline of the inner picket 51 is secured to an upper cap 63 located at the upper end of the inner picket 51. A weighted block 65 is located adjacent the lower cap 59 to force the lower end of the inner picket 51 downwardly into the water, but is not of such weight as to eliminate the bouyancy of the inner pickets 51. The core 57 of each inner picket 51 has a densified surface to withstand normal abrasion, but for the most severe conditions, an outer plastic tubing 69 fitted over the core 57 provides maximum abrasion resistance. The inner pickets 51 may also be foreshortened to maintain the core 57 of the floatation material below the water line and have only a blunt rod extending above the water line. In this way, burning oil on the surface of the water will not ignite the floatation material of the inner pickets 51.

The pickets are held together by a lower tape 71, which could be a rope but a tape, preferably a synthetic tape is the most desirable form of the lower tape 71. The lower tape 71 is located in the horizontal space 45 between the lower fused strips 43. The lower tape 71 has a snap 72 at each end. Each snap 72 is secured to one of the loops or rings 53 at the lower end of the inner pickets 51. The lower tape 71 holds the inner pickets 51 in place vertically. The length of the lower tape 71 is selected to provide with sufficient excess in relation to the length of the panel 23 to provide the bands 13 with freedom of action while also preventing the inner pickets 51 from moving excessively away from adjacent inner pickets 51 and thereby placing a tensile load for each band 13. This enhances the ability of each of the bands 13 to accommodate wave action while at the same time, preventing the inner pickets 51 from crowding together which would create an unstable deployment of the fence 11.

The preferred design of the panels 23 and the bands 11 is to have the upper edge fused strip 33 and the upper fused strips 41 and the lower fused strips 43. However, fused strips 39 may include additional fused strips (not shown) providing the function of the fence 11 is not prevented. However, the fused strips 39 as shown and described provides sufficient strength at the most economical cost.

One of the important features of the fence 11 as described herein, is that the fused strips 39 are all horizontal and that the placement of fused strips 39 on the bands 13 and panels 23 creates a straight-line repetitive design making possible a continuous production process rather than a periodic processing as would be required without such a straight-line repetitive design. The continuous processing is available not only with heat fusion but also with sewing to create the fused strips. The use of heat fusion or sewing will depend, of course, upon the material selected. Certain coated fabrics cannot be heat sealed but are highly desirable for chemical and fire resistance. On the other hand, an electronically sealed unreinforced plastic band 13, can be made very inexpensively for one-time, throw-away usage.

Figure 4:
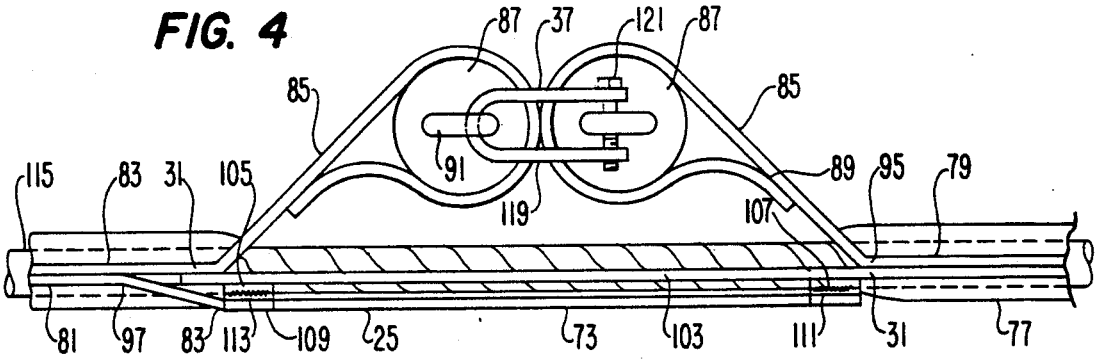
FIG. 4 is an enlarged top view showing the connection of two adjoining bands of the fence with the end pickets pressed together and the interior and exterior covers secured to one another to further seal the juncture between the two end pickets from leakage.

The fence 11, as best seen in FIG. 4, has two sides, namely, a contaminated side 73 and a clean side 75. The contaminated side 73 is as would be expected, placed toward the impurities to be confined The clean side 75 faces away from the impurities. The two plies 25 used to form each of the bands 13, which in combination are used to assemble the fence 11, can best be described as a contaminated ply 77 which forms the contaminated side 73 of the fence 11, located toward the impurities and a clean ply 79 which forms the clean side located away from the impurities of the fence 11. Both the clean ply 79 and the contaminated ply 77 have concealed surfaces 81 which face one another and exposed surfaces 83 which face away from one another. As has been previously stated, both the contaminated ply 77 and the clean ply 79 form flaps 35 which extend beyond each band 13. To form the connection or juncture 37 between adjacent bands 13, a picket flap 85, which is an extension of the clean ply 79, is folded back on itself and tightly wrapped about an end picket 87 which is similar to, but distinct from the inner pickets 51. The picket flap 85 extends completely about the end picket 87 and is secured to its own concealed surface by a vertical fused strip 89.

Figure 5:
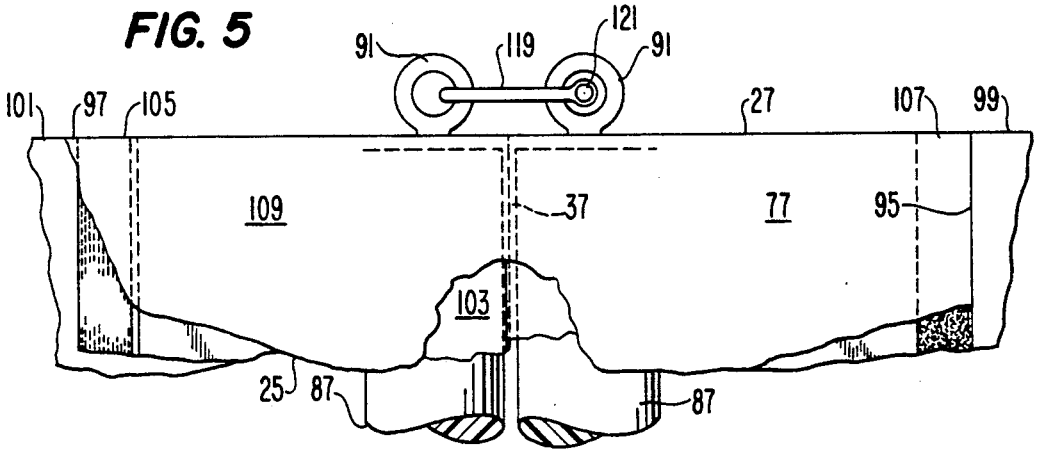
FIG. 5 is a fragmented front elevation of the juncture of two adjoining bands showing the end pickets and the exterior cover and interior cover.
Figure 6:
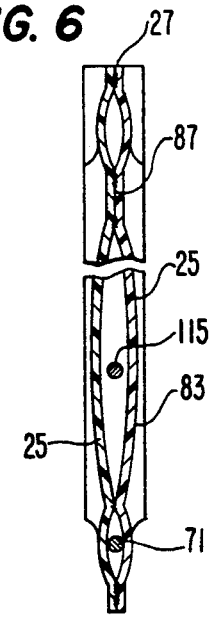
FIG. 6 is a vertical cross-sectional view along line 6—6 of FIG. 2.
Figure 7:
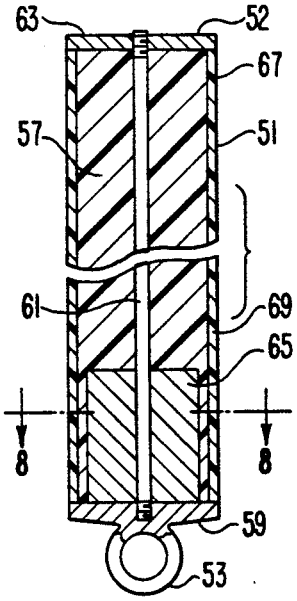
FIG. 7 is a longitudinal cross-sectional view of an inner picket

The end pickets 87, as best shown in FIGS. 4 and 5, are constructed in the same manner as the inner pickets 51 except that the upper end of an end picket 87 includes an upper ring or loop 91 as well as a lower ring or loop 93 similar to the ring 53 of the inner pickets 51.

The end pickets 87 and inner pickets 51 are molded, in their entirety, with only lower end rings 53 and 93 and upper rings 91 extending from the core 57. By molding the inner pickets 51 and the end pickets 87 in their entirety, water and oil are substantially excluded from the core 57.

The one-step molding process for the inner pickets 51 and the end pickets 87 also creates a dense and impervious surface 67.

Each band 13, as viewed toward the inner side 73, has a left end 95 and a right end 97. As best seen in FIG. 4, the left end 95 of a right band 99 is seen toward the right side of FIG. 4 and the right end 97 of a left band 101 is seen toward the left side of FIG. 4. The flap 35 extending from the contaminated ply 77 of the left end 95 of each band 13, as viewed as stated above, forms an interior cover 103 for the connection or juncture 37 between bands 13. Each interior cover 103 has a vertical strip of adhesive material 105, such as hook and loop material, on its exposed surface 83 at the end of the interior cover 103 and another vertical strip of adhesive material 107 on the exposed surface 83 of the interior cover 103 adjacent the right band 99. The flap 35 extending from the contaminated ply of the right end 97 of each band 13 forms an exterior cover 109. Each exterior cover 109 has a vertical strip of adhesive material 111 on its concealed surface 81 at the end of the exterior cover which adheres to the vertical strip of adhesive material 107 on the exposed surface 83 of the interior cover 103 adjacent the right band 99. The exterior cover 109 also has a vertical adhesive strip 113 on its concealed surface 81 adjacent to the left band 101 which engages the vertical strip of adhesive material 105 at the end of the interior cover 103.

The interior cover 103 from the left end 95 of the right band 99 and the exterior cover 109 from the right end 97 of the left band 101, in combination, seal the connection or juncture 37 between the end pickets 87 as seen in FIGS. 4 and 5. The interior cover 103 is located beneath the exterior cover 109 with the exterior cover closest to the impurities being confined.

A control rope 115 extends between the contaminated ply 77 and the clean ply 79 generally midway between the upper edge 27 and the lower edge 29 and extends for the length of each band 13. The control rope 115 connects band 13 to band 13 along the length of the fence 11 by means of any suitable fastening means engaging loops 117 at the ends of adjacent bands 13. The control rope 115 goes around the inner pickets 51, preferably between the inner pickets 51, and the inner ply 77.

The end pickets 87, as seen in FIG. 4, are located outwardly from the control rope 115 and the interior cover 103 and exterior cover 109. Shackles 119 including bolts or other attachment means at the upper rings 91 and lower rings 93 of two connecting end pickets 89 tightly secure the end pickets 87 together. Should it be desired to have end pickets 87 with flotation material only below the water line, a tube of low density metal mesh extends above the waterline to assure a firm line of contact between adjoining and connected end pickets 87.

The invention may be embodied in other specific forms without departing from the spirit or essential characteristics thereof. The present embodiments are therefore, to be considered in all aspects as illustrative and not restrictive. The scope of the invention is indicated by the appended claims rather than the foregoing description and all changes which come within the meaning and range of equivalency of the claims are therefore intended to be embraced therein.

I claim:

1. A fence for enclosing impurities floating on water, comprising:

a series of bands of material which is flexible and impervious, the bands being connected end to end at junctures, each band having two ends and being formed from two plies of the material; both of the plies of material being longer than the band to form a pair of flaps at each end of a band to provide a cover means for the juncture between the two bands, the two plies being fused together in a plurality of horizontal strips to form vertical pockets between the two plies;

a plurality of inner pickets each having an upper end and a lower end and including a material having a density lighter than water and a weight having a density heavier than water at the lower end of each inner picket, each inner picket being located in a vertical pocket;

means for connecting the inner pickets together within a band;

a control means extending beyond each band and having a connecting means at each end for connecting together the control means of the series of bands;

a pair of end pickets each having an upper end and a lower end and including a material having a density lighter than water and a weight having a density heavier than water at the lower end of each end picket, means for securing one end picket of the pair of end pickets to the end of one band and for securing the other end picket of the pair of end pickets to the end of the adjoining band; and means for firmly securing the end pickets of two adjoining bands firmly together.

2. A fence according to claim 1 wherein each of the inner pickets has a ring at its lower end and the rings are tied together by a tape means.

3. A fence according to claim 1 wherein each of the end pickets has a ring at its upper end and at its lower end and the end pickets of adjoining bands are secured together at the rings at the upper end and at the lower end.

4. A fence according to claim 1 wherein each band has an upper edge and a lower edge and each band further includes a plurality of panels, the two plies of each band being fused together along the upper edge of the band in n upper edge fused strip, each panel being further fused together by a pair of upper strips and a pair of lower fused strips, the pair of upper fused strips and the pair of lower fused strips being parallel to one another and to the upper edge fused strip and being vertically aligned with one another and of substantially the same length as one another, the pair of upper fused strips in each panel being horizontally aligned and in a spaced relationship with the pair of upper fused strips in all other panels of the band and the pair of lower fused strips being horizontally aligned and in a spaced relationship with the pair of lower fused strips in all other panels of the band.

5. A fence for enclosing impurities floating on water, comprising:

a series of bands of material which is flexible and impervious, the bands being connected end to end at junctures, each band having two ends and being formed from two plies of the material, both of the plies of material being longer than the band to form a pair of flaps at each end of a band, one of the flaps at each end of adjoining bands being folded over and adhered to another flap from an adjoining band to provide a cover means for the juncture between the two bands, the two plies within the bands, being fused together to form vertical pockets between the two plies;

a plurality of inner pickets each having an upper end and a lower end and including a material having a density lighter than water and a weight having a density heavier than water at the lower end of each inner picket, each inner picket being located in a vertical pocket;

means for connecting the inner pickets together within a band;

a control rope located between the two plies and extending beyond each band and having a connecting means at each end for connecting together the control ropes of the series of bands.

a pair of end pickets each having an upper end and a lower end and including a material having a density lighter than water and a weight having a density heavier than water at the lower end of each end picket, one of the pair of end pickets being wrapped in one flap at the end of one band and the other one of the pair of end pickets being wrapped in the other flap at the end of the adjoining band; and means for firmly securing the end pickets of two adjoining bands firmly together.

6. A fence according to claim 5 wherein each of the inner pickets has a ring at its lower end and the rings are tied together by a cable means.

7. A fence according to claim 5 wherein each of the end pickets has a ring at its upper end and at its lower end and the end pickets of adjoining bands are firmly secured together at the rings at the upper end and at the lower end.

8. A fence according to claim 5 wherein each band has an upper edge and a lower edge and each band further includes a plurality of panels, the two plies of each band being fused together along the upper edge of the band in an upper edge fused strip, each panel being further fused together by a pair of upper strips and a pair of lower fused strips, the pair of upper fused strips and the pair of lower fused strips being parallel to one another and to the upper edge fused strip and being vertically aligned with one another and of substantially the same length as one another, the pair of upper fused strips in each panel being horizontally aligned and in a spaced relationship with the pair of upper fused strips in all other panels of the band and the pair of lower fused strips being horizontally aligned and in a spaced relationship with the pair of lower fused strips in all other panels of the band.

9. A fence for enclosing impurities floating on water, comprising:

a series of bands of flexible, impermeable material connected end to end at junctures, each band having an upper edge and a lower edge and being formed from two plies of the same material, one ply being a contaminated ply to be located toward the impurities and the other ply being a clean ply located away from the impurities, each band having a left end and a right end as viewed toward the contaminated ply, each of the plies being longer than the band to form at the left end of each band one cover for the juncture from the contaminated ply and a left flap from the clean ply and to form at the right end of each band another cover for the junction from the contaminated ply and a right flap from the clean ply, each band further including a plurality of panels, each panel having substantially the same length, the two plies being fused together in an upper edge fused strip along the upper edge of the band, each panel being further fused together by a plurality of fused strips;

a plurality of inner pickets each having an upper end and a lower end and including a material having a density lighter than water and a weight having a density heavier than water at the lower end of each inner picket, each inner picket being located between the two plies and between adjoining panels and having a ring located at its lower end, the upper end of each picket being pressed against the upper edge fused strip;

means for connecting together within each band the rings at the lower end of the inner pickets;

a control rope located between the two plies and between the plurality of fused strips, said control rope extending beyond each band and having a connecting means at each end for connecting together the control ropes of the series of bands;

a pair of end pickets each having an upper end and a lower end and including a material having a density lighter than water and a weight having a density heavier than water at the lower end of each end picket, one end picket being wrapped in the left flap and another end picket being wrapped in the right flap, both the left flap and the right flap being fused to itself along a vertical fused strip, both covers having mating adhesive strips on their surfaces which bond together holding the covers together; and means for firmly securing the end pickets of two adjoining bands firmly together at the upper rings and lower rings of the end pickets.

10. A fence for enclosing impurities floating on water, comprising:

a series of bands of material which is flexible and impervious, the bands being connected end to end at junctures, each band having an upper edge and a lower edge and being formed from two plies of the material, one ply being a contaminated ply to be placed toward the impurities and the other ply being a clean ply to be placed away from the impurities, each band having a left end and a right end as viewed toward the inner ply, each ply having a concealed surface and an exposed surface, the concealed surfaces of the contaminated ply and the clean ply facing one another and the exposed surfaces being opposite from the concealed surfaces, each of the plies being longer than the band to form at the left end of each band an interior cover for the juncture from the contaminated ply and a left flap from the clean ply and to form at the right end of each band an exterior cover for the junction from the contaminated ply and a right flap from the clean ply, both the interior cover and the exterior cover having a vertical end remote from the band; each band further including a plurality of panels, each panel being substantially the same length, the two plies being fused together in an upper edge fused strip along the top edge of the band, each panel being further fused together by a pair of upper fused strips and a pair of lower fused strips, the pair of upper fused strips and the pair of lower fused strips being parallel to one another and to the upper edge fused strip and being vertically aligned with one another and of substantially the same length as one another, the pair of upper fused strips in each panel being horizontally aligned and in a spaced relationship with the pair of upper fused strips in all other panels of the band, the pair of lower fused strips being horizontally aligned and in a spaced relationship with the pair of lower fused strips in all other panels of the band;

a plurality of inner pickets each having an upper end and a lower end and including a material having a density lighter than water and a weight having a density heavier than water at the lower end of each inner picket, each inner picket being located between the two plies and between adjoining panels and having a ring located at its lower end, the upper end of each picket being pressed against the upper edge fused strip;

means connecting together within each band the rings at the lower end of the inner pickets;

a control rope located between the two plies and between the pair of upper fused strips and a pair of the lower fused strips and between the contaminated ply and the inner pickets, said control rope extending beyond each band and having a connecting means at each end for connecting together the control ropes of the series of bands;

a left end picket and a right end picket each having an upper end and a lower end and including a material having a density lighter than water and a weight having a density heavier than water at the lower end of each end picket, the left end picket being wrapped in the left flap and the right end picket being wrapped in the right flap, both the left flap and the right flap being fused to itself along a vertical fused strip, the interior cover having a vertical adhesive strip on its exposed surface at the vertical end of the interior cover remote from the panel and a vertical adhesive strip on its exposed surface adjacent the panel and the exterior cover having a vertical adhesive strip on its concealed surface at the vertical end of the exterior cover remote from the panel and a vertical adhesive strip on its concealed surface adjacent the panel, the vertical adhesive strips on the vertical ends of the exterior and interior covers bonding with the vertical adhesive strips on the exterior panel and interior panel adjacent the panel; and means for securing the end pickets of two adjoining bands firmly together at the upper rings and lower rings of the end pickets.

11. A fence for enclosing impurities floating on water, comprising:

a series of bands of flexible, impermeable material connected end to end at junctures, each band having an upper edge and a lower edge and being formed from two plies of material, one ply being a contaminated ply to be placed toward the impurities and the other ply being a clean ply located away from the impurities, each band having a first end and a second end, each ply having a concealed surface and an exposed surface, the concealed surfaces of the contaminated ply and the clean ply facing one another and the exposed surfaces being opposite from the concealed surfaces, each of the plies being longer than the band to form at the first end of each band an interior cover for the juncture from the contaminated ply and a first flap from the clean ply and at the second end of each band an exterior cover for the junction from the contaminated ply and a second flap from the clean ply, both the interior cover and the exterior cover having a vertical end remote from the band; each band further including a plurality of panels;

a plurality of inner pickets each having an upper end and a lower end and including a material having a density lighter than water and a weight having a density heavier than water at the lower end of each inner picket, each inner picket being located between the two plies;

a first end picket and second end picket each having an upper end and a lower end and including a material having a density lighter than water and a weight having a density heavier than water at the lower end of each end picket, the first end picket being wrapped in the first flap and the second end picket being wrapped in the second flap, both the first flap and the second flap being fused to itself along a vertical fused strip, the interior cover having a vertical adhesive strip on its exposed surface of the vertical end of the interior cover remote from the panel and a vertical adhesive strip on its exposed surface adjacent the panel and the exterior cover having a vertical adhesive strip on its concealed surface at the vertical end of the exterior cover remote from the panel and a vertical adhesive strip on its concealed surface adjacent the panel, the vertical adhesive strips on the vertical ends of the exterior and interior covers binding with the vertical adhesive strips on the exterior cover and interior cover adjacent the panel; and means for firmly securing the end pickets of two adjoining bands firmly together.

* * * * *